US007663858B2

(12) United States Patent
Santero

(10) Patent No.: US 7,663,858 B2
(45) Date of Patent: Feb. 16, 2010

(54) CONTROL DEVICE FOR ELECTRO-ACTUATORS WITH PROTECTION AGAINST SHORT-CIRCUITS TO GROUND OR TO THE SUPPLY OF THE TERMINALS OF THE ELECTRO-ACTUATORS

(75) Inventor: Paolo Santero, Orbassano (IT)

(73) Assignee: C.R.F. Societa Consortile per Azioni (IT)

( * ) Notice: Subject to any disclaimer, the term of this patent is extended or adjusted under 35 U.S.C. 154(b) by 274 days.

(21) Appl. No.: 10/993,385

(22) Filed: Nov. 19, 2004

(65) Prior Publication Data

US 2005/0152086 A1 Jul. 14, 2005

(30) Foreign Application Priority Data

Nov. 20, 2003 (IT) ..... TO2003A0922

(51) Int. Cl.
*H01H 9/00* (2006.01)
*H02H 3/08* (2006.01)

(52) U.S. Cl. ..... 361/160; 361/93.1

(58) Field of Classification Search ..... 361/160, 361/63.1

See application file for complete search history.

(56) References Cited

U.S. PATENT DOCUMENTS 5,159,516 A * 10/1992 Fujihira ..... 361/18
5,724,218 A * 3/1998 Tihanyi ..... 361/79
6,236,554 B1 * 5/2001 Groppo et al. ..... 361/191
6,624,994 B1 * 9/2003 Schmoock et al. ..... 361/93.1

FOREIGN PATENT DOCUMENTS

DE 4026398 A1 2/1991
EP 0 358 972 A1 3/1990
EP 0 924 589 A1 6/1999

OTHER PUBLICATIONS

ST, IRFP460 N-Channel 500V-0.22ohm-18.4A to-247 PowerMesh II MOSFET, May 2001 pp. 1-8.*

* cited by examiner

*Primary Examiner*—Stephen W Jackson
*Assistant Examiner*—Scott Bauer
(74) *Attorney, Agent, or Firm*—Ostrolenk Faber LLP

(57) ABSTRACT

A control device (2) for an electro-actuator (3) comprising a first and a second input terminal (4, 5) connected to an electrical energy source (6); a first and a second output terminal (10, 11) connected to the electro-actuator (3); and selectively controlled switches (16, 17, 18) which can be activated in order to connect the first and second output terminals (10, 11) to the first and second input terminals (4, 5) in predetermined operative conditions; the controlled switches (17, 18) comprise first controlled switches (17) which are connected between the first input terminal (4) and the first output terminal (10) and second controlled switches (18) which are connected between the second input terminal (5) and the second output terminal (11); the control device (2) additionally comprises first sensors (31) which are connected to the ends of the first controlled switches (17) and provide a first signal ($V_{HS}$) which is indicative of the current flowing in the first controlled switches (17).

10 Claims, 1 Drawing Sheet

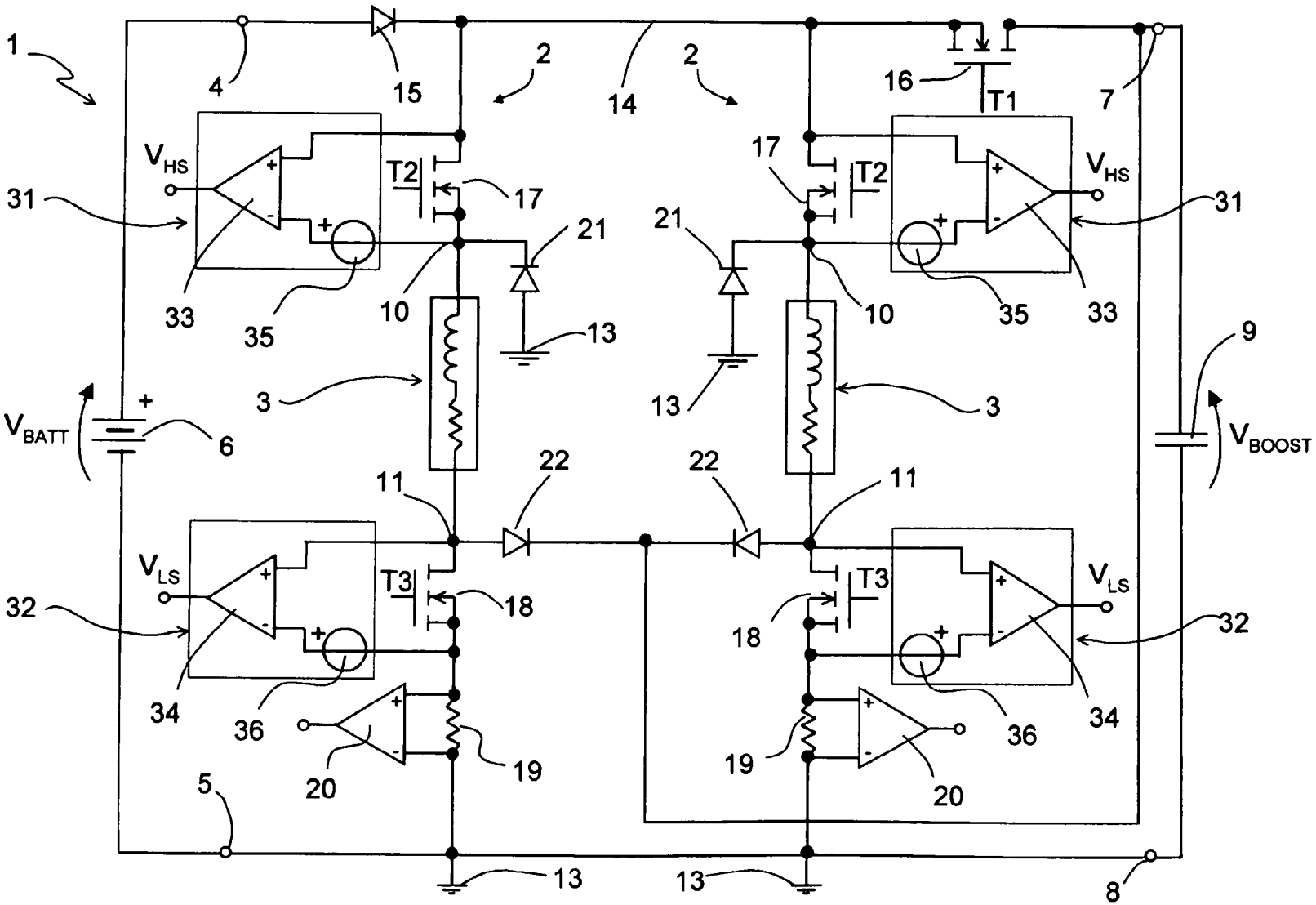
$V_{BOOST}$
$V_{HS}$
$V_{LS}$
$V_{BATT}$
T1
T2
T3
1
2
3
4
5
6
7
8
9
10
11
13
14
15
16
17
18
19
20
21
22
31
32
33
34
35
36

CONTROL DEVICE FOR ELECTRO-ACTUATORS WITH PROTECTION AGAINST SHORT-CIRCUITS TO GROUND OR TO THE SUPPLY OF THE TERMINALS OF THE ELECTRO-ACTUATORS

FIELD OF THE INVENTION

The present invention relates to a control device for electro-actuators with protection against short-circuits to ground or to the supply of the terminals of the electro-actuators.

In particular, the present invention can be applied advantageously, but not exclusively, in the control of electro-injectors of a fuel injection system of an internal combustion engine of a motor vehicle, and in particular a common rail injection system of a diesel engine, to which the description will refer explicitly, without however detracting from generality.

The control device according to the invention can however be applied to other types of engines, such as petrol, methane or LPG engines, or to any other type of electro-actuators such as, for example, solenoid valves of ABS devices and the like, solenoid valves of variable timing systems, etc.

BACKGROUND OF THE INVENTION

As is known, for control of the electro-injectors of a common rail injection system, each electro-injector is habitually supplied with a current, the development of which over a period of time comprises a section of rapid increase to a first maintenance value, a first section of amplitude which oscillates around the first maintenance value, a first section of decrease to a second maintenance value, a second section of amplitude which oscillates around a second maintenance value, and a second section of rapid decrease to a value of approximately zero.

In fact, as is known, an electro-injector comprises an outer body defining a cavity which communicates with the exterior via an injection nozzle, and in which there is accommodated a pin which is mobile axially in order to open and close the nozzle, under the opposite axial thrusts of the pressure of the fuel injected on the one hand, and of a spring and a rod on the other hand, which rod is disposed along the axis of the pin, on the side opposite the nozzle, and is activated by an electromagnetically controlled metering valve.

In the initial stage of opening of the electro-injector, it is necessary not only to apply considerable force against the action of the spring, but also the rod must be moved from the position of rest to the position of activation in the shortest possible time. For this reason, the excitation current for the electro-magnet in the first stage is somewhat high (first maintenance value). The rapid increase in the development of the current to the first maintenance value is necessary in order to guarantee sufficient temporal precision at the moment of initiation of the activation. However, once the rod has reached the final position, the electro-injector remains open even with currents which are less high, such as the sections of decrease and maintenance around the second maintenance value in the development of the excitation current of the electro-magnet.

In order to obtain this development of the excitation current, use was previously made of a control device in which the electro-injectors were connected firstly directly to a supply line, and secondly to a ground line, via a controlled electronic switch.

However, this control device had the disadvantage that any short-circuit to ground of one of the terminals of any of the electro-injectors, caused for example by a loss of insulation in a wiring conductor of the electro-injectors themselves and by contact of this conductor with the bodywork of the motor vehicle, gave rise to definitive damage to the electro-injector itself and/or to the control device, thus causing the vehicle engine to cut out, which is a decidedly dangerous situation when travelling.

In order to eliminate this dangerous disadvantage, European patent EP 0 924 589 in the name of the applicant proposed a control device in which the electro-injectors are floating in relation to the supply line, i.e. they are connected to the supply line and to the ground line via respective controlled electronic switches, which are general produced by means of MOSFET transistors. By this means, any short-circuit to ground or to the supply of one of the terminals of the electro-injectors does not cause damage to the control device, and therefore make the vehicle engine cut out, but simply leads to non-use of that individual electro-injector, thus making it possible to continue travelling with one electro-injector less.

In particular, in the control device described in the said patent, the presence of a short-circuit to ground or to the supply of one of the terminals of the electro-injectors is determined on the basis of the voltages which are present at the terminals of the electro-injectors themselves.

In detail, to each of the terminals of the electro-injectors there is connected a CMOS logic gate with hysteresis, for example a logic inverter, which supplies as output a feedback logic signal which assumes a low logic level when the voltage which is present at the corresponding terminal is higher than the upper threshold voltage of the CMOS logic gate itself, and a high logic level when the voltage which is present at the corresponding terminal is lower than the lower threshold voltage of the CMOS logic gate.

The presence of faults at the terminals of the electro-injectors is thus determined by detecting any incompatibilities between the values of the control logic signals of the controlled electronic switches which connect the electro-injectors to the supply line and to the ground line, and the feedback logic signals generated by the CMOS logic gates connected to the terminals of the electro-injectors.

If a fault is detected, activation of the electro-injector at which this fault has occurred is immediately interrupted by opening the controlled electronic switches which connect it to the supply line and to the ground line, such as to disconnect it physically from the remainder of the control device and therefore allow the engine to continue to run, even if with a reduced number of cylinders and reduced performance levels.

Although extensively used, this type of protection of the electro-injectors, against short-circuits to ground or to the supply of their terminals, has some disadvantages which do not permit adequate use of all their merits.

In particular, if there is a short-circuit to ground of the terminal of an electro-injector which is connected to the supply line, when the controlled electronic switch which connects the terminal to this supply line is closed, this short-circuit is not detected in good time, and a very high current flows into the controlled electronic switch.

In fact, in the above-described circuit topology, in order to detect the presence of this short-circuit to ground, the voltage of the terminal of the electro-injector which is connected to the supply line should drop below the lower threshold voltage of the CMOS logic gate connected to this terminal, such as to trigger the gate and thus switch the feedback logic signal supplied by the latter.

In reality however, even in the presence of a short-circuit to ground, the voltage of the terminal of the electro-injector which is connected to the supply line is unlikely to drop below the threshold indicated. In fact, in order for this to take place, the voltage at the ends of the controlled electronic switch which is connected to the supply line must assume a value equivalent to about 10 V (battery voltage, which is generally approximately 12 V, less the lower threshold voltage of the CMOS logic gate, which is generally approximately 2 V), and since the resistance of a controlled electronic switch is usually in the order of tens of mΩ a current of several hundred amps must flow in this switch.

However, this situation cannot arise since it is not possible have such strong short-circuits, i.e. such low short-circuit resistances, as to permit passage of a current with this value. Consequently, in the event of a short-circuit to ground of an electro-injector which is connected to the supply line, the voltage of this terminal drops, but not to the extent that it falls below the lower threshold voltage of the CMOS logic gate.

The consequence of this is that, in addition to the failure to detect the fault, there is also passage of very high short-circuit currents which are not detected by the CMOS logic gates, and can therefore damage the control device of the electro-injectors, or, in the best of hypotheses, which can supply it with incorrect diagnostic information induced by the electric noise generated by the short-circuit current itself.

The object of the present invention is thus to provide a control device for electro-actuators which is free from the above-described disadvantages.

BRIEF DESCRIPTION OF THE INVENTION

According to the present invention, a control device for electro-actuators is provided, as defined in claim 1.

BRIEF DESCRIPTION OF THE DRAWING(S)

The above and other objects, features and advantages of the present invention will become more apparent from the following detailed description when taken in conjunction with the accompanying drawing in which:

FIG. 1 is an illustration of the control device according to the present invention.

DETAILED DESCRIPTION OF THE INVENTION

In order to assist understanding of the present invention, a preferred embodiment is now described purely by way of non-limiting example, and with reference to the attached FIGURE, which shows a circuit diagram of a control device for electro-actuators, according to a preferred embodiment of the present invention.

As shown in this FIGURE, the control device, which is indicated as 1 as a whole, comprises a plurality of control circuits 2, one for each electro-injector 3. For the sake of simplicity of illustration, FIG. 1 shows only two control circuits 2 relating to two electro-injectors 3, which belong to a single engine bearing (not shown), each of which is represented in FIG. 1 with its corresponding equivalent circuit formed by a resistor and an inductor connected in series.

Each control circuit 2 comprises a first and a second input terminal 4, 5, which are connected respectively to the positive pole and to the negative pole of the battery 6 of the motor vehicle, which provides a voltage $V_{BATT}$, the nominal value of which is typically equivalent to 13.5 V; a third and a fourth input terminal 7, 8, which are connected to a booster circuit 9 which is common to all the control circuits 2, and supplies a boosted voltage $V_{BOOST}$ which is greater than the battery voltage $V_{BATT}$, for example 50 V; and a first and a second output terminal 10, 11, between which a corresponding electro-injector 3 is connected. In its simplest embodiment, the booster circuit is formed by a single capacitor 9, known as the "boost" capacitor.

The terminal of each electro-injector 3 connected to the first output terminal 10 of the corresponding control circuit 2, is typically known as the "highside" (HS) or hot-side terminal, whereas the terminal of each electro-injector 3 connected to the second output terminal 11 of the corresponding control circuit 2 is typically known as the "lowside" (LS) or cold-side terminal.

Each control circuit 2 additionally comprises a ground line 13 which is connected to the second input terminal 5 and to the fourth input terminal 8, and a supply line 14 which is connected on the one hand to the first input terminal 4 via a first diode 15, the anode of which is connected to the first input terminal 4 and the cathode of which is connected to supply line 14, and is connected on the other hand to the third input terminal 7 via a first transistor 16 of the MOSFET type, the gate terminal of which receives a first control signal T1, the drain terminal of which is connected to the third input terminal 7, and the source terminal of which is connected to the supply line 14.

Each control circuit 2 additionally comprises a second transistor 17 of the MOSFET type, with a gate terminal which receives a second control signal T2, a drain terminal which is connected to the supply line 14, and a source terminal which is connected to the first output terminal 10; and a third transistor 18 of the MOSFET type with a gate terminal which receives a third control signal T3, a drain terminal which is connected to the second output terminal 11, and a source terminal which is connected to the ground line 13 via a sense stage, formed by a sense resistor 19, to the ends of which there is connected an operational amplifier 20 which generates as output a voltage which is proportional to the current which flows in the sense resistor 19 itself.

The transistors 17 and 18 are defined respectively as the "highside" and "lowside" transistors since they are connected respectively to the highside and lowside terminals of the corresponding electro-injectors 3.

Each control circuit 2 additionally comprises a second diode 21, known as the "free-wheeling" diode, the anode of which is connected to the ground line 13 and the cathode of which is connected to the first output terminal 10; and a third diode 22, known as the "boost" diode, the anode of which is connected to the second output terminal 11 and the cathode of which is connected to the third input terminal 7.

Finally, each control circuit 2 comprises a device for protection against short-circuits, the purpose of which is to allow the engine control system to detect faults, such as short-circuits to ground, of the highside terminals of the electro-injectors, and short-circuits to the supply, of the lowside terminals of the electro-injectors, such as to prevent the engine from cutting out and to provide useful information during the stage of elimination of the faults themselves.

In particular, the protection device comprises a first threshold comparator 31 which has a first and a second input connected respectively to the drain and source terminals of the transistor 17 and an output which supplies a logic signal $V_{HS}$; and a second threshold comparator 32 which has a first and a second input connected respectively to the drain and source terminals of the transistor 18 and an output which supplies a logic signal $V_{LS}$.

As shown in the FIGURE, each threshold comparator 31, 32 can advantageously be produced by means of an operational amplifier 33, 34 and a threshold voltage generator 35, 36. In particular, the operational amplifier 33, 34 has a non-inverting terminal which is connected to the drain terminal of the corresponding transistor 17, 18, an inverting terminal which is connected to the source terminal of the corresponding transistor 17, 18 via the corresponding threshold voltage generator 35, 36, and an output which supplies a logic signal, respectively $V_{HS}$ and $V_{LS}$.

In particular, the threshold voltage generator 35 of the first threshold comparator 31 supplies a first threshold voltage $V_{TH_HS}$ and has a positive terminal connected to the inverting terminal of the corresponding operational amplifier 33 and a negative terminal connected to the source terminal of the corresponding transistor 17, whereas the threshold generator 36 of the second threshold comparator 32 supplies a second threshold voltage $V_{TH_LS}$ and has a positive terminal connected to the inverting terminal of the corresponding operational amplifier 34 and a negative terminal connected to the source terminal of the corresponding transistor 18.

The general functioning of each control circuit 2 can be subdivided into three distinct main stages, characterised by a different development of the current circulating in the electro-injector 3, i.e. a first stage, known as the rapid-loading or boost stage, in which the current increases rapidly to a maintenance value, such as to open the electro-injector 3; a second stage, known as the maintenance stage, in which the current oscillates with a saw-tooth development around the value obtained in the preceding stage; and a third stage, known as the rapid-discharge stage, in which the current decreases rapidly from the value assumed in the preceding stage, to a final value, which can also be zero.

In particular, in the rapid-loading stage, the transistors 16, 17 and 18 are closed, and thus the boosted voltage $V_{BOOST}$ is applied to the ends of the electro-injector 3. By this means, the current flows in the grid comprising the capacitor 9, the transistor 16, the transistor 17, the electro-injector 3, the transistor 18 and the sense resistor 19, increasing over a period of time in a manner which is substantially linear with a gradient equivalent to $V_{BOOST}/L$ (where L represents the equivalent series inductance of the electro-injector 3). Since $V_{BOOST}$ is much greater than $V_{BATT}$, the increase in the current is much faster than that which can be obtained with $V_{BATT}$.

In the maintenance stage, the transistor 18 is closed, the transistor 16 is open and the transistor 17 is closed and opened repeatedly, and thus at the ends of the electro-injector 3 there is alternate application of the battery voltage $V_{BATT}$ (when the transistor 17 is closed) and a zero voltage (when the transistor 17 is open). In the first case (transistor 17 closed), the current flows in the grid comprising the battery 6, the diode 15, the transistor 17, the electro-injector 3, the transistor 18, and the sense resistor 19, and increases exponentially over a period of time, whereas in the second case (transistor 17 open), the current flows in the grid comprising the electro-injector 3, the transistor 18, the sense resistor 19 and the free-wheeling diode 21, decreasing exponentially over a period of time.

Finally, in the rapid discharge stage, the transistors 16, 17 and 18 are open, and thus, until current passes through the electro-injector 3, the boosted voltage $-V_{BOOST}$ is applied to the terminals of the electro-injector 3 itself. By this means, the current flows in the grid comprising the capacitor 9, the boost diode 22, the electro-injector 3 and the free-wheeling diode 21, decreasing over a period of time in a substantially linear manner with a gradient equivalent to $-V_{BOOST}/L$. Since $V_{BOOST}$ is much greater than $V_{BATT}$, the decrease in the current is much faster than that which can be obtained with $V_{BATT}$. In this stage, the electrical energy which is stored in the electro-injector 3 (equivalent to $E=\frac{1}{2}\cdot L\cdot I^2$) is transferred to the capacitor 9, such as to permit recovery of part of the energy supplied by the control circuit 2 during the rapid loading stage, thus increasing the efficiency of the system.

In the rapid loading and maintenance stages, the opening and closing of the transistors 16, 17 and 18 is controlled by the engine control system on the basis of the logic signal supplied by the operational amplifier 20 which is connected to the ends of the sense resistor 19 and is indicative of the value of the current flowing in the electro-injector 3, whereas the duration of the rapid discharge stage is determined by calculation.

By means of the appropriate combination and repetition of some or all of the three above-described stages, each control circuit 2 can generate current profiles of the developed "peak and hold" type, with various types and degrees of complexity, thus making it possible to implement various strategies of injection of fuel, each comprising multiple injections timed closely to one another.

On the other hand, as far as the functioning of the protection device is concerned, the threshold comparator 31 is designed to detect the presence of a short-circuit to ground of the highside terminal of the corresponding electro-injector 3 when the transistor 17 is switched on, whereas the threshold comparator 32 is designed to detect the presence of a short-circuit to the supply of the lowside terminal of the corresponding electro-injector 3 when the transistor 18 is switched on.

In particular, concerning detection of a short-circuit to ground of the highside terminal of the electro-injector 3 when the transistor 17 is switched on, the threshold comparator 31 compares the voltage which is present between the drain and source terminals of the highside transistor 17 with the threshold voltage $V_{TH_HS}$, and supplies a feedback logic signal $V_{HS}$ which is indicative of the result of this comparison.

In detail, when the highside transistor 17 is switched on, the current $I_D$ which passes through it gives rise to a voltage drop $V_{DS}$ at the channel resistor $R_{DS_ON}$. equivalent to:

$$V_{DS}=R_{DS_ON}\cdot I_D$$

Since the type of MOSFET transistor used is known, its $R_{DS_ON}$ is also known, although with a certain margin of uncertainty, and its variation associated with temperature is also known (in particular its increase associated with the temperature).

This therefore determines the maximum value $R_{DS_ON_MAX}$ which the channel resistor can assume on the basis of the production dispersions and the maximum junction operative temperature. There is therefore also determination of the maximum value $V_{DS}$ which the voltage drop can reach in the case of maximum current circulating in the highside transistor 17, $I_{D_MAX}$, in the normal operative conditions:

$$V_{DS_MAX}=R_{DS_ON_MAX}\cdot I_{D_MAX}$$

When the value of the threshold voltage $V_{TH_HS}$ is set to a value higher than $V_{DS_MAX}$:

$$V_{TH_HS}>V_{DS_MAX}$$

there is certainty that any short-circuit will be detected, since as soon as the short-circuit current exceeds the value $I_{D_MAX}$ the voltage drop $V_{DS}$ exceeds the threshold voltage $V_{TH_HS}$, thus giving rise to switching of the feedback logic signal $V_{HS}$ supplied by the threshold comparator 31.

The MOSFET transistors which are usually used have a channel resistance of 10÷20 mΩ, which increases to approximately 20÷40 mΩ at the maximum junction temperature, and the threshold voltage $V_{TH_HS}$ can be set for example to the value of 0.8÷1.6 mV, such that a short-circuit of approximately 40A can be detected.

The control circuits 2 for the electro-injectors can withstand a current with this value for a few tens of micro-seconds without problems. This time interval is sufficient for the engine control system to detect the fault and switch off the transistor connected to the terminal affected by the fault, such as to disconnect the electro-injector from the corresponding control circuit 2 and by this means prevent damage to the control device 1.

Use of the maximum value of the channel resistance $R_{DS_ON_MAX}$ determined at the maximum junction operative temperature, in order to determine the value of the threshold voltage $V_{TH_HS}$ does not create problems in functioning at low temperatures, since in the event of a short-circuit, the current which passes through the transistor gives rise in any case to a sudden increase in the junction temperature.

In addition, since the engine control system has the information relating to the implementation stage in which the fault occurred and to the logic state of the control signals of the transistors and of the voltage feedbacks, it can carry out diagnosis of the type of problem which has occurred and for example transmit a corresponding error code to any diagnostics instrument.

Considerations altogether similar to those previously described can be applied in order to detect a short-circuit to the supply of the lowside terminal of the corresponding electro-injector 3, when the transistor 18 is switched on.

In fact, as soon as the lowside terminal of the electro-injector 3 goes to a voltage which is the same as the battery voltage $V_{BATT}$, or close to the latter, the voltage $V_{DS}$ between the drain and source terminals of the transistor 18 exceeds the threshold voltage $V_{TH_LS}$ (set to a value greater than the maximum voltage $V_{DS}$ which can be reached in normal operative conditions $V_{DS_MAX}$), and the threshold comparator 32 switches, thus indicating the presence of a fault to the engine control system.

Examination of the characteristics of the control device according to the present invention makes apparent the advantages which can be obtained by means of the invention.

In particular, it is clear that the invention makes it possible to obtain protection against short-circuits to ground or to the supply of the terminals of the electro-injectors, by carrying out a type of measurement of the current which circulates in the electro-injectors themselves, without however introducing an actual additional sense stage (consisting of a sense resistor and a corresponding circuit for amplification and conditioning of the signal), which would lead to a substantial increase in the complexity of the circuit and in the corresponding costs.

By this means, there is a considerable increase in the resistance to faults of the control circuit for the electro-actuators, which can now detect the presence of short-circuits to ground of the highside terminal of the electro-injectors and to the supply of the lowside terminal of the electro-injectors themselves, without however affecting adversely the simplicity of the circuit and the corresponding production costs.

In addition, the engine control system need not be modified, thus minimising the modifications which need to be made to the existing circuitry.

Finally, it is apparent that modifications and variations can be made to the control circuit described and illustrated here, without departing from the protective scope of the present invention, as defined in the attached claims.

The invention claimed is:

1. Control device for an electro-actuator comprising a first and a second input terminal which are connected, in use, to an electrical energy source; a first and a second output terminal which are connected, in use, to the electro-actuator; and selectively controlled switch means which is activated in order to connect the first and second output terminals to the first and second input terminals in predetermined operative conditions; controlled switch means comprising first controlled switch means which are connected between the first input terminal and the first output terminal and second controlled switch means which are connected between the second input terminal and the second output terminal; the control device comprises:

first detector means which are connected to the ends of the first controlled switch means and provide a first signal ($V_{HS}$) of the current flowing in the first controlled switch means, wherein the first detector means comprises:

first threshold comparator means which are configured to compare a value correlated to the current flowing in the first controlled switch means with a first threshold value ($V_{TH_HS}$) of a predetermined upper limit for the current flowing in the first controlled switch means and generates the first signal ($V_{HS}$); the first signal ($V_{HS}$) indicating whether the current flowing in the first controlled switch means has exceeded the upper limit or not, the predetermined upper limit comprising the maximum current flowing ($I_{D_MAX}$) in the first controlled switching means under normal operating conditions, the control device further comprising a threshold generator element which supplies the first threshold value with a value such as to cause a complete shutdown of the current when current flowing is outside a normal operating condition;

wherein the maximum current flowing in the first controlled switching means under normal operating conditions is a function of the current $I_D$ which passes through the first controlled switching means, when turned on, giving rise to a voltage drop $V_{DS}$ equal to $R_{DS_ON} \cdot I_D$ with $R_{DS_ON}$ having known values for the first controlled switching means and a known maximum current $I_{D_MAX}$, wherein $V_{DS_MAX}=R_{DS_ON_MAX} \cdot I_{D_MAX}$, with detection of any short circuit when the value of the threshold voltage $V_{TH_HS}$ exceeds $V_{DS_MAX}$, through the first controlled switching means, wherein $R_{DS_ON_MAX}$ is the channel resistance at the maximum junction temperature, having a predetermined known value for the first controlled switch, without functioning problems at low temperatures, with the device being configured such that passing current therethrough on short circuit gives rise to a sudden increase in junction temperature.

2. Control device according to claim 1, wherein the value is the voltage at the ends of the first controlled switch means.

3. Control device according to claim 1, wherein the first threshold comparator means comprise:

first amplifier means which have a first and a second input connected respectively to a first and a second current conduction terminal of the first controlled switch means; and first voltage generator means which are connected in series to one of the inputs of the first amplifier means, and supply a voltage which is equivalent to the first threshold value ($V_{TH_HS}$).

4. Control device according to claim 1, additionally comprising:

second detector means which are connected to the ends of the second controlled switch means and supply a second signal ($V_{LS}$) which indicates the current flowing in the second controlled switch means.

5. Control device according to claim 4, wherein the second detector means comprise:

second threshold comparator means which compare a value correlated to the current flowing in the second controlled switch means with a second threshold value ($V_{TH_LS}$) which indicates a predetermined upper limit for the current flowing in the second controlled switch means in order to generate the second signal ($V_{LS}$); the second signal ($V_{LS}$) indicating whether the current flowing in the second controlled switch means has exceeded the said upper limit or not.

6. Control device according to claim 5, wherein the value is the voltage at the ends of the said second controlled switch means.

7. Control device according to claim 5, wherein the second threshold comparator means comprise:

second amplifier means which have a first and a second input connected respectively to a first and a second current conduction terminal of the second controlled switch means; and second voltage generator means which are connected in series to one of the inputs of the second amplifier means, and supply a voltage which is equivalent to the second threshold value ($V_{TH_LS}$).

8. Control device according to claim 1, wherein the first and second controlled switch means comprise MOSFET transistors.

9. Method for detection of short-circuits to ground or to the supply of the terminals of an electro-actuator which is controlled by means of a control device comprising a first and a second input terminal which are connected, in use, to an electrical energy source; a first and a second output terminal which are connected, in use, to the electro-actuator; and selectively controlled switch means which are activated in order to connect the first and second output terminals to the first and second input terminals in predetermined operative conditions; the controlled switch means comprising first controlled switch means which are connected between the first input terminal and the first output terminal and second controlled switch means which are connected between the second input terminal and the second output terminal; the method comprising the stages of:

detecting an electrical value which indicates the current flowing in at least one from amongst the first and second controlled switch means;

comparing the electrical value with a threshold value ($V_{TH_HS}$, $V_{TH_LS}$); and detecting the presence of short-circuits to ground or to the supply, if the electrical value has a predetermined relationship with the said threshold value ($V_{TH_HS}$, $V_{TH_LS}$);

the electrical value is the voltage at the ends of the at least one from amongst the first and second controlled switch means, and the threshold value ($V_{TH_HS}$, $V_{TH_LS}$) indicates a predetermined upper limit for the current flowing in the at least one from amongst the first and second controlled switch means, wherein the first detector means comprises:

first threshold comparator means which compare a value correlated to the current flowing in the first controlled switch means with a first threshold value ($V_{TH_HS}$) which indicates a predetermined upper limit for the current flowing in the first controlled switch means in order to generate the first signal ($V_{HS}$); the first signal ($V_{HS}$) indicating whether the current flowing in the first controlled switch means has exceeded the upper limit or not, the predetermined upper limit comprising the maximum current flowing ($I_{D_MAX}$) in the first controlled switching means under normal operating conditions, with the first threshold value having a value such as to cause a complete shutdown of the current when the current flowing is outside a normal operating condition;

wherein the maximum current flowing in the first controlled switching means under normal operating conditions is a function of the current $I_D$ which passes through the first controlled switching means, when turned on, giving rise to a voltage drop $V_{DS}$ equal to $R_{DS_ON} \cdot I_D$ with $R_{DS_ON}$ having known values for the first controlled switching means and a known maximum current $I_{D_MAX}$ wherein $V_{DS_MAX}=R_{DS_ON_MAX} \cdot I_{D_MAX}$, with detection of any short circuit when the value of the threshold voltage $V_{TH_HS}$ exceeds $V_{DS_MAX}$.

through the first controlled switching means, wherein $R_{DS_ON_MAX}$ is the channel resistance at the maximum junction temperature, having a predetermined known value for the first controlled switch, without functioning problems at low temperature, with the device being configured such that passing current therethrough on short circuit gives rise to a sudden increase in junction temperature.

10. Method according to claim 9 wherein the electrical value with the threshold value ($V_{TH\text{-}HS}$) is compared to the maximum current flowing ($V_{DS\text{-}MAX}$) in the first controlled switching means under normal operating conditions to detect a short to ground and wherein the electrical value with the threshold value ($V_{TH\text{-}HS}$) is compared to the electrical value with maximum current flowing ($V_{DS\text{-}MAX}$) in the second controlled switching means under normal operating conditions to detect a short to the supply.

* * * * *